US005911677A

United States Patent [19]

Kupelian

[11] Patent Number: 5,911,677

[45] Date of Patent: Jun. 15, 1999

[54] ROPE CHAIN JEWELERY AND METHOD FOR CUTTING THEREOF

[76] Inventor: Mike M. Kupelian, 849 Marconi St., Montebello, Calif. 90640

[21] Appl. No.: 09/158,470

[22] Filed: Sep. 22, 1998

Related U.S. Application Data

[63] Continuation-in-part of application No. 29/052,450, Mar. 20, 1996, Pat. No. Des. 398,551.

[51] Int. Cl.[6] ..... B21L 15/00

[52] U.S. Cl. ..... 59/35.1; 59/80

[58] Field of Search ..... 59/3, 35.1, 80, 59/82

[56] References Cited

U.S. PATENT DOCUMENTS

| | | | |
|---|---|---|---|
| D. 398,551 | 9/1998 | Kupelian | D11/18 |
| 5,115,959 | 5/1992 | Weinberg et al. . | |
| 5,125,225 | 6/1992 | Strobel . | |
| 5,285,625 | 2/1994 | Ofrat et al. . | |
| 5,535,583 | 7/1996 | Holzer et al. | 59/35.1 |
| 5,581,992 | 12/1996 | Borouchov | 59/35.1 |
| 5,653,100 | 8/1997 | Dal Monte | 59/35.1 |
| 5,737,910 | 4/1998 | Rozenwasser | 59/35.1 |

OTHER PUBLICATIONS

*SISMA*, Specification Sheet for a Machine for Polishing Chains.

*Sassounian Inc.*, Specification Sheet for CHETAN Diamond Milling Machines, p. 58.

*Sassounian Inc.*, Specification Sheet for Universal Faceting & Milling Machine Combined Double Head, p. 59.

*Primary Examiner*—David Jones

*Attorney, Agent, or Firm*—Loeb & Loeb LLP

[57] ABSTRACT

The present invention is directed to an apparatus and method for fabricating a spiral diamond cut rope chain having at least one strand with an outer surface that is cut into a flat, concave, or other configuration, that is smooth, consistent, and even and is preferably highly reflective to light so as to be visually appealing and desirable. The spiral diamond cut surfaces of the rope chain are formed on the strands of links by cutting away the material of the strands of the rope chain with a rotating diamond blade.

13 Claims, 10 Drawing Sheets

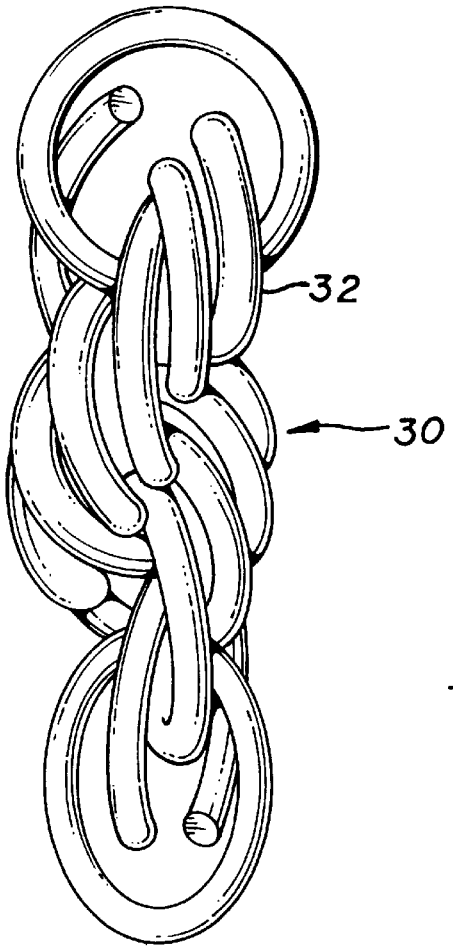
FIG. 1
PRIOR ART
FIG. 2
PRIOR ART
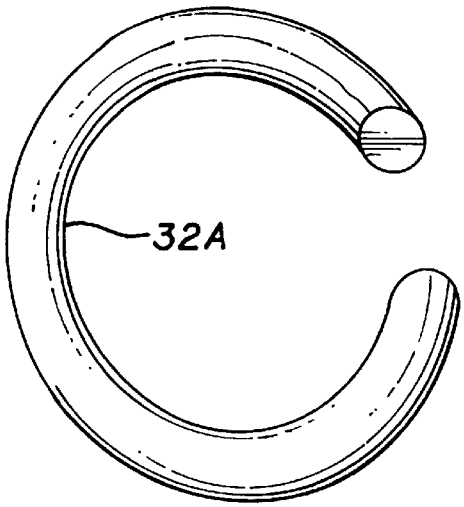
FIG. 3
PRIOR ART
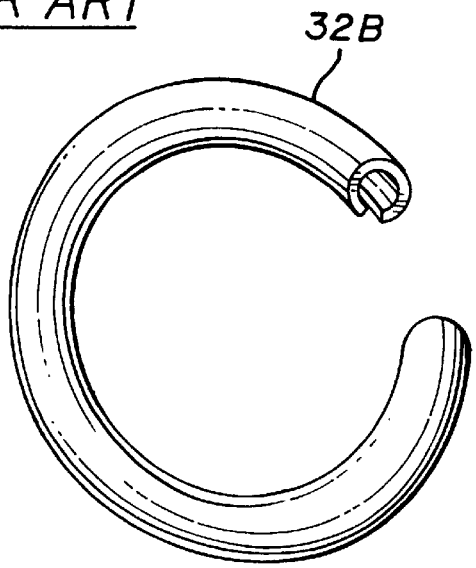
FIG. 4
PRIOR ART
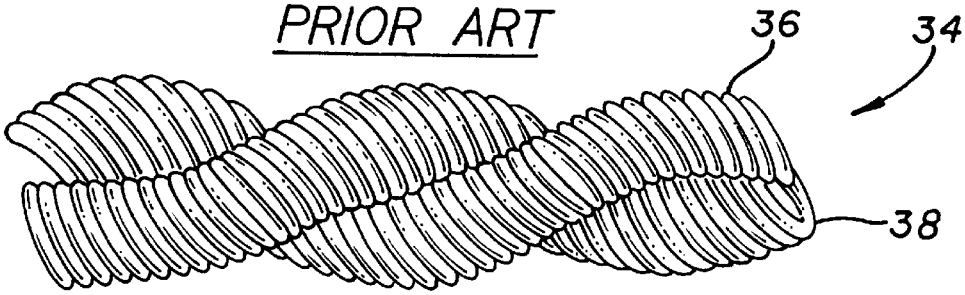

FIG. 6
PRIOR ART
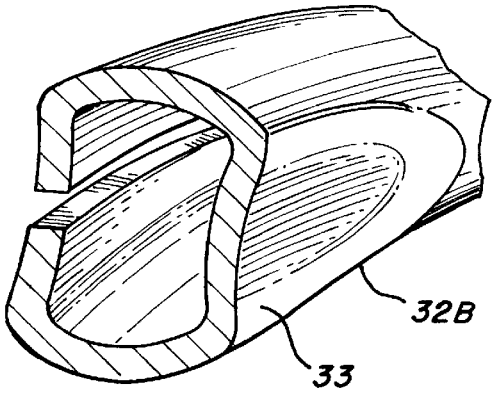
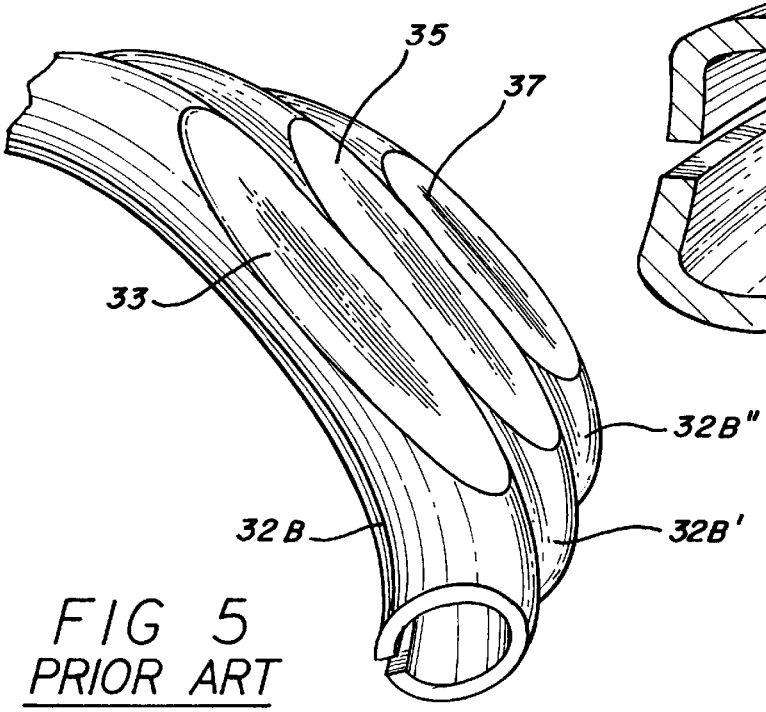
FIG 5
PRIOR ART
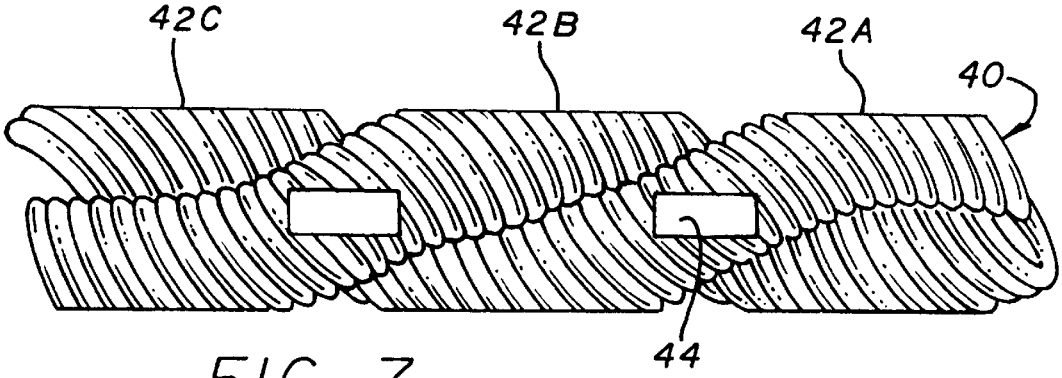
FIG. 7
PRIOR ART

FIG. 14
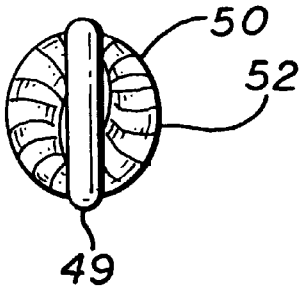
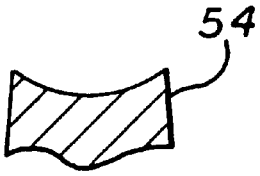
FIG. 15
FIG. 16
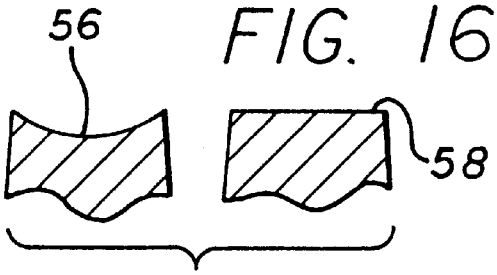
FIG. 17
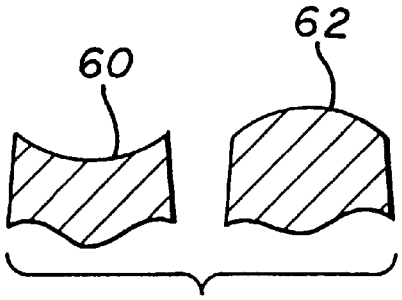

ROPE CHAIN JEWELERY AND METHOD FOR CUTTING THEREOF

RELATED APPLICATION

This application is a continuation-in-part of design patent application Ser. No. 29/052,450, filed Mar. 20, 1996, incorporated herein by reference.

BACKGROUND OF THE INVENTION

1. Field of the Invention

The present invention generally relates to rope chain jewelry, particularly to spiral diamond cut rope chains and apparatus and methods for cutting thereof.

2. Description of the Related Art

Rope chain jewelry is a chain in the form of a rope constituted by a helical series of open rings or links that are interlinked with one another to define a configuration similar to a continuous double-stranded rope. Rope chains made of solid rings are simply known as rope chains while those made of hollow rings or links are known as "hollow rope chains".

The present invention is directed specifically to a type of rope chain to be known as a "spiral diamond cut rope chain" which derives from, but provides a look which differs from, the conventional "diamond cut rope chain", discussed below.

Apparatus and methods for fabricating rope chains are known in the prior art as exemplified by U.S. Pat. No. 5,115,959 to Weinberg et al. which is directed to an automatic soldering machine for soldering a rope chain. Weinberg et al., discloses a machine having a pair of gears, each with a peripheral surface defining a trench for engaging one of the strands of a rope chain to feed and place successive link junctions of the rope chain relative to a series of hollow soldering needles.

A detailed discussion of a method for making a conventional diamond cut rope chain is provided in U.S. Pat. No. 5,125,225 to Strobel which discloses a process for making a hollow diamond cut rope chain. The Strobel patent also describes common problems inherent in fabricating a hollow diamond cut rope chain. For example, to achieve a square or hexagonal cross-section chain, the depth of the diamond cut must be greater than the outer shell thickness of the link of which a hollow rope chain is to be made. If one were to attempt to precut each link before assembly, the resulting links would be differently sheared or deformed making it impossible to assemble them into a completed rope chain having the conventional diamond cut.

As disclosed in the Strobel patent, a diamond cut rope chain is a type of chain in which the links of the chain are given a certain degree of shine and/or sparkle by shaving off or shearing away flat sections (also called facets) from the outer surface of the solid toroidal-shaped links, leaving relatively flat surfaces for light to reflect therefrom. Diamond cutting of solid link rope chains is done with a non-rotating, sharp diamond blade capable of creating a deep cut into the outer surface of the rope chain by scraping away sections from the outer surfaces of the rope chain which is tightly wound on a rotatable lathe drum.

U.S. Pat. No. 5,285,625 to Ofrat et al. discloses a rope chain with diamond cut facets which extend spirally around the longitudinal center of the chain. The chain can be formed of solid or hollow links. The Ofrat et at. patent attempts to provide a spiral diamond cut rope chain having a flattened or decorated outer surface. Diamond cut facets are formed on the links of the chain in a path that extends helically around the chain by faceting each of the individual links at one or more locations thereon. The Ofrat et al. patent is also directed to a process of forming diamond cut faceting in the individual hollow or solid links of an assembled jewelry rope chain.

Specifically, Ofrat et al. disclose an apparatus for applying a shearing force to the rope chain on diametrically opposed sides thereof and on the individual links that are in that instant at a predetermined holding position adjacent the cut forming tools. The shearing force applied to the links results in a scraping away of sections from the outer surfaces of the links. Such scraping and shearing force on the chain links is affected by the friction, contour, and geometry of the surface being cut, which in the case of a series of links present in a rope chain results in an overall uneven cut of the chain facet being formed.

None of the prior art apparatus and methods for cutting a rope chain teach a cutting force that is a controlled rotational cutting force, to create a cut surface that is smooth and even, such that the cut surfaces of the links exhibit much greater shine and reflectivity to make the rope chain more desirable to consumers.

Therefore, the need arises for a spiral diamond cut jewelry rope chain that has a smooth, consistent, and even spiral faceted outer surface and method for fabricating the same. Such a rope chain should have a high quality shine and reflectivity so as to be highly desirable and attractive to consumers.

SUMMARY OF THE INVENTION

The present invention is directed to an apparatus and method for fabricating a spiral diamond cut rope chain having at least one strand with an outer surface that is cut into a flat, concave, or other configuration, that is smooth, consistent, and even and is preferably highly reflective to light so as to be visually appealing and desirable. The spiral diamond cut surfaces of the rope chain are formed on the strands of links by cutting away a portion of the material of the strands of the rope chain with a rotating diamond blade. The cutting of a surface of the rope chain is also referred to herein as "faceting" and a cut surface is also referred to herein as a "facet".

The path of faceting the strands of the rope chain by the rotating diamond blade(s) spirals around the longitudinal axis of the rope chain. For example, the path of faceting in a two stranded rope chain would be a double helix wrapped around the longitudinal axis of the chain. Each link is faceted by rotating diamond blade(s) at one or more locations depending on the design of the cut desired. The faceting itself may be in a variety of shapes such as, but not limited to flat, concave, convex, rounded, and the like and the faceted links can have any finish desired. The links may be solid, hollow or of cross-sectional shapes other than the standard circular cross-section.

To fabricate a spiral diamond cut rope chain in accordance with one embodiment of the present invention; a segment of a two-stranded helical jewelry rope chain made of closely intertwined links is tensioned at each end to a rotating device, such as a motor for example., each motor being secured to a platform. The diamond blades are removably mounted to a circular sawlike bit which rotates in a vertical plane directly above the outer surface of the rope chain at an angle to the longitudinal axis of the rope chain. The angle of mounting of the blades on the circular bit and/or the size and shape of the blades may be varied depending on the type of spiral cut desired by the operator. The diamond blade bit is powered by a blade motor which is movable along the longitudinal axis of the rope chain. The blade motor may be slideably mounted to a rail above the chain with the rail being attached at both ends to a platform above the rope chain.

The blade motor and the two chain motors are connected to a motor controller which synchronizes the operation of the motors to ensure smooth and even cutting of the chain. The spinning diamond blade bit is moved over the outer surface of the rope chain which is also spinning at a selected speed. The rotating diamond blade bit cuts the outer surface of a strand of the rope chain at a predetermined depth or sequence to remove the desired amount of material from the rope chain strands. A spiral diamond cut may be achieved by the synchronized rotation of the chain and movement of the rotating diamond blade bit which cuts the spiral strands of the rope chain as it moves horizontally along the axis of the chain.

In another embodiment of the present invention, a hollow open ended tubular chain carrier having internal spiral grooves to match the spiral configuration of the strands of the rope chain, is threaded over the rope chain such that the rope chain passes through the chain carrier. Each end of the rope chain is coupled to a free spinning bushing mounted on opposite ends of a platform. The free spinning bushings are capable of rotation in both clockwise and counterclockwise directions in a vertical plane which can be the same plane in which the diamond blade bit is spinning. The hollow chain carrier may be mounted to the sliding apparatus holding the rotating diamond blade and the blade motor is actuated. As the hollow chain carrier moves along the length of the rope chain, the rope chain passes through the internal spiral grooves of the chain carrier which causes the chain to rotate about its longitudinal axis as the ends of the chain are free to rotate with the free spinning bushings. The result is a spiral diamond cut of the rope chain.

In any of the above-described embodiments of the present invention, a guide wire can be spirally coiled in the spaces between two strands of the rope chain before mounting the chain on the chain motors or free spinning bushings as described above. The coiled guide wire prevents sagging of the chain, holds the links of the rope chain in a stable position, and provides additional guiding and structural support for the chain as the rotating diamond blade bit cuts the outer surface of the chain as it moves along the longitudinal axis of the chain. The guide wire has a smaller diameter than the diameter of the individual strands of the rope chain and is positioned between the strands such that the guide wire itself is beyond the reach of the rotating diamond blade bit. After the desired spiral cut is accomplished, the wire is manually or automatically uncoiled from the chain and can be used again if desired.

These and other embodiments, features, and advantages of the present invention will become apparent from the following detailed description of the invention and accompanying drawings.

BRIEF DESCRIPTION OF THE DRAWINGS

FIG. 1 is a front perspective view of a prior art segment of standard uncut rope chain in the process of being assembled;

FIG. 2 is a front perspective view of a prior art single solid link for use in assembly of a standard solid rope chain;

FIG. 3 is a front perspective view of a prior art single hollow link for use in assembly of a standard hollow uncut rope chain;

FIG. 4 is a front perspective view of a prior art assembled portion of a standard hollow uncut rope chain;

FIG. 5 is a close-up partial sectional perspective view of several of the links shown in FIG. 4;

FIG. 6 is a further close-up partial sectional perspective view of one of the hollow links of FIG. 4 with a partially complete diamond cut impression;

FIG. 7 is front perspective view of a prior art assembled rope chain which has been faceted to provide it with the conventional diamond cut look;

FIG. 14 is an end view of a spiral diamond cut rope chain in accordance with the present invention, the opposite end being identical;

FIG. 15 is an enlarged cross sectional view taken along the lines 15—15 of FIG. 11;

FIG. 16 is an enlarged cross sectional view taken along the lines 16—16 of FIG. 11;

FIG. 17 is an enlarged cross sectional view taken along the lines 17—17 of FIG. 11;

DETAILED DESCRIPTION OF THE INVENTION

Figure 8:
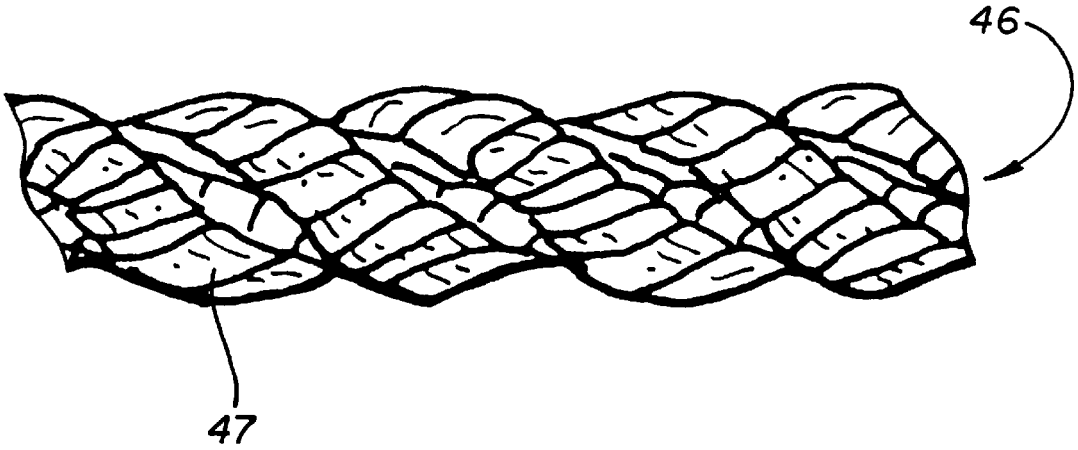
FIG. 8 is front perspective view of an assembled rope chain portion which has been spirally cut in accordance with the present invention.

The following description includes the best mode presently contemplated for carrying out the invention. This description is not to be taken in a limiting sense, but is made merely for the purpose of describing the general principles of the invention.

Prior Art

FIGS. 1–7 are examples of prior art rope chain jewelry. Specifically, FIG. 1 illustrates a segment of an unsoldered standard jewelry rope chain 30 comprised of intertwined helical series of toroidal shaped links 32 so as to provide a continuous spiral double-stranded rope when fully assembled. As shown in FIGS. 2–3, links 32 may be solid (link 32A) or hollow (link 32B). The standard jewelry rope chain 30 can be assembled manually or automatically by forming, feeding, and spirally interlinking the links 32 so that two continuous helical strands coiled around each other result. The open links are then soldered to one another resulting in a double-stranded jewelry rope chain 34 shown in FIG. 4. Rope chain 34 comprises strands 36 and 38 in a helically coiled configuration.

With reference to FIGS. 5 and 6, links 32B, 32B', 32B" are shown deformed by a conventional shearing diamond blade with flattened surfaces 33, 35 and 37 respectively. Specifically, FIG. 6 illustrates a typical hollow annular link 32B being deformed inwardly by facet section 33 by a standard incremental application of blunt force upon the outer surface wall of link 32B in the region of facet 33. Even though the shown links are hollow, solid links are conventionally cut in a similar manner although not by a blunt force but by a sharp-edged diamond knife which scrapes away a portion of the outer surface wall of the solid link resulting in a similar flattened surface or facet. The use of blunt force in hollow links is preferred as a sharp diamond knife may pierce and damage the thin outer shell of the hollow link during the scraping process.

FIG. 7 depicts a conventional diamond cut rope chain 40 having sequential shaved off or faceted portions 42A, 42B and 42C with faceted surfaces 42A and 42C being on the same strand and flattened surface 42B being on the adjacent strand. Defining portions 42A, 42B and 42C as sub-facets, one straight line of sub-facets will henceforth be defined as a facet. The facet formed by sub-facets 42A, 42B and 42C which lie substantially in the same plane is shown in the figure as a straight line parallel to the longitudinal axis 43 of rope chain 40 which is in effect a standard conventional diamond cut. Due to the nature of this cut, certain links are shaved off to a greater degree than other links which results in an uneven and consequently undesirable diamond cut jewelry rope chain. A diamond cut rope chain of this type has a rectangular cross section and the cut rope chain can lie on a flat surface in the region of each of the facet lines. This, however, would not be true for a spiral diamond cut rope chain which if put on a flat surface would tend to roll.

Present Invention

Turning to the present invention, FIG. 8 illustrates a portion of a spiral diamond cut rope chain 46 that has been cut in accordance with the present invention. Note that facet 47 in this case is not a straight line but a spiral (or curve) following one of the strands of rope chain 46.

Figure 9:
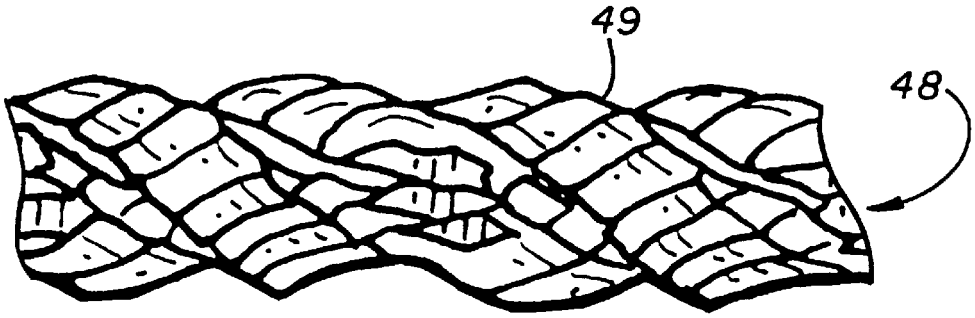
FIG. 9 is front perspective view of an assembled rope chain portion which has been spirally cut in accordance with the present invention.
Figure 10:
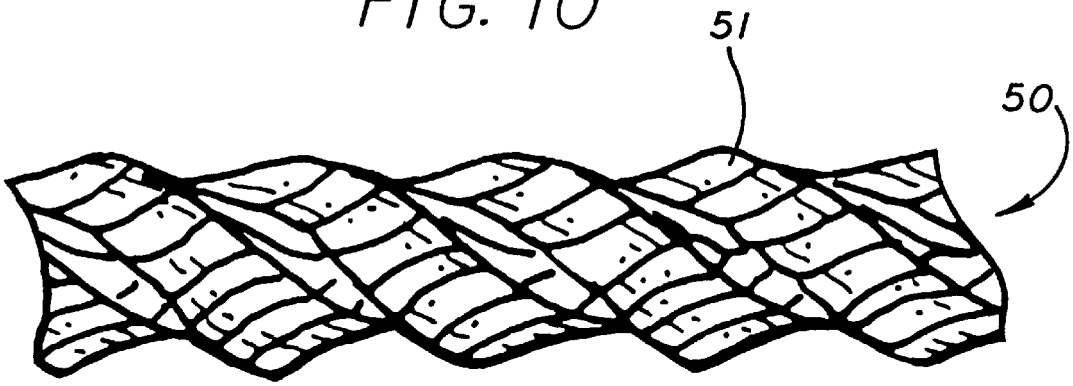
FIG. 10 is front perspective view of an assembled rope chain portion which has been spirally cut in accordance with the present invention.

FIGS. 9 and 10 show two alternative spiral diamond cuts of rope chains 48 and 50 respectively. Note that facets 49 and 51 respectively are again not straight lines but strand-following spirals similar to the facet of FIG. 8.

Figure 11:
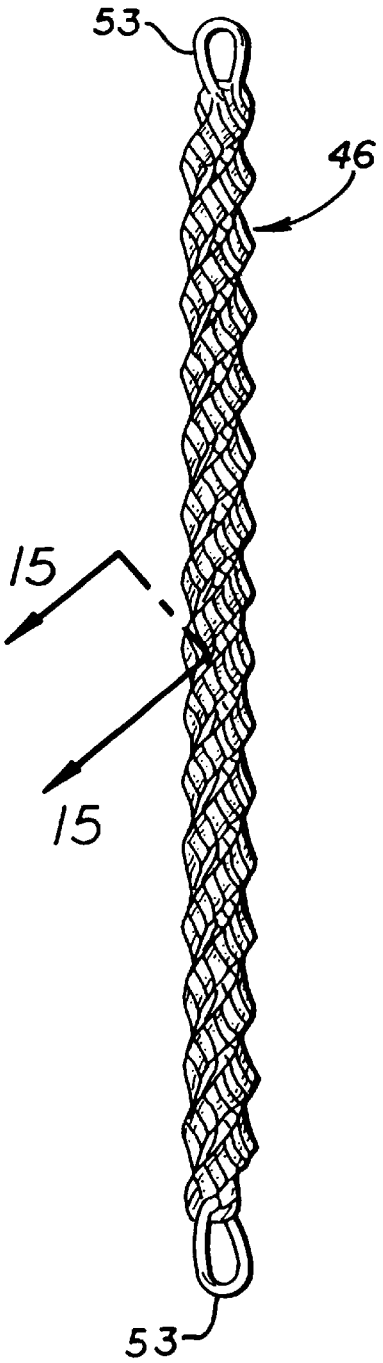
FIG. 11 is a front elevational view of a spiral diamond cut rope chain showing one type of spiral cut in accordance with the present invention, the rear and side elevational views being identical.
Figure 12:
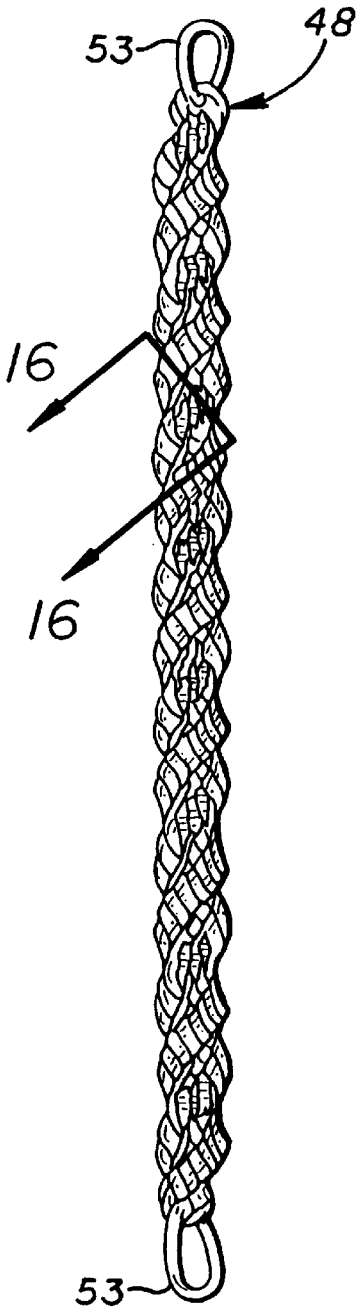
FIG. 12 is a front elevational view of a spiral diamond cut rope chain showing an alternative spiral cut in accordance with the present invention, the rear and side elevational views being identical.
Figure 13:
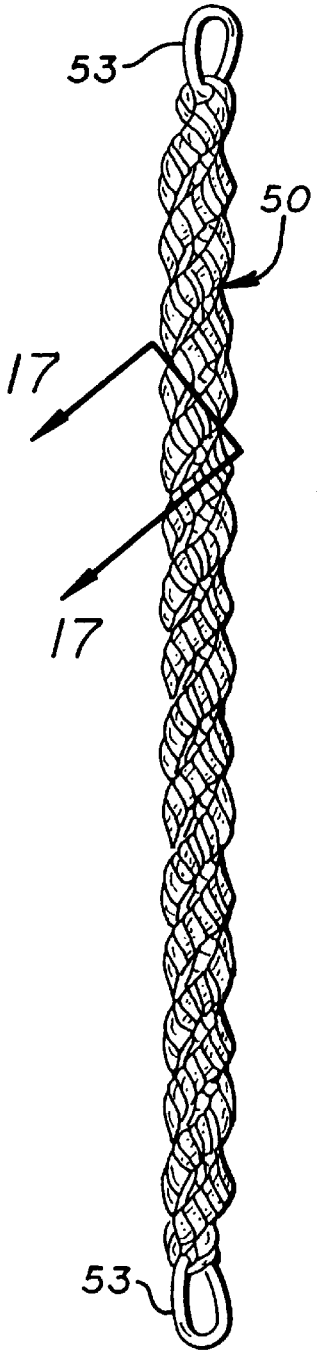
FIG. 13 is a front elevational view of a spiral diamond cut rope chain showing another alternative spiral cut in accordance with the present invention, the rear and side elevational views being identical.

FIGS. 11, 12, and 13 illustrate three types of finished spiral diamond cut rope chains 46, 48 and 50 having been fabricated in accordance with the present invention. Each finished rope chain has a pair of clasps 53, respectively, for coupling together the ends of the rope chain. Each of the finished spiral diamond cut rope chains 46, 48 and 50 have attractive, shiny, and highly reflective facets that are visually appealing and desirable to consumers.

FIG. 14 is a view of end 52 of rope chain 50 having a clasp 53.

As can be seen in FIGS. 15–16, each of the rope chains 46, 48, and 50 is cut differently. For example, rope chain 46 has a continuous cut along its strands whereby cross section 54 of each faceted strand has a concave outer surface as shown in FIG. 15. The strands of rope chain 48 have been cut such that the cross section 56 of one faceted strand has a concave outer surface and the cross section 58 of the other faceted strand has a feat outer surface as shown in FIG. 16. Rope chain 50 is a variation of the cut of rope chain 48 in that the cross section 60 of one faceted strand has a concave outer surface and the other strand is left uncut to provide a cross-section with a rounded outer surface.

The present invention is also directed to an apparatus and method for fabricating a jewelry rope chain with the above-described types of spiral diamond cut and variations thereof. The actual fabrication is done by a novel spiral diamond cutting apparatus which is schematically shown in FIGS. 18–19A.

Figure 18:
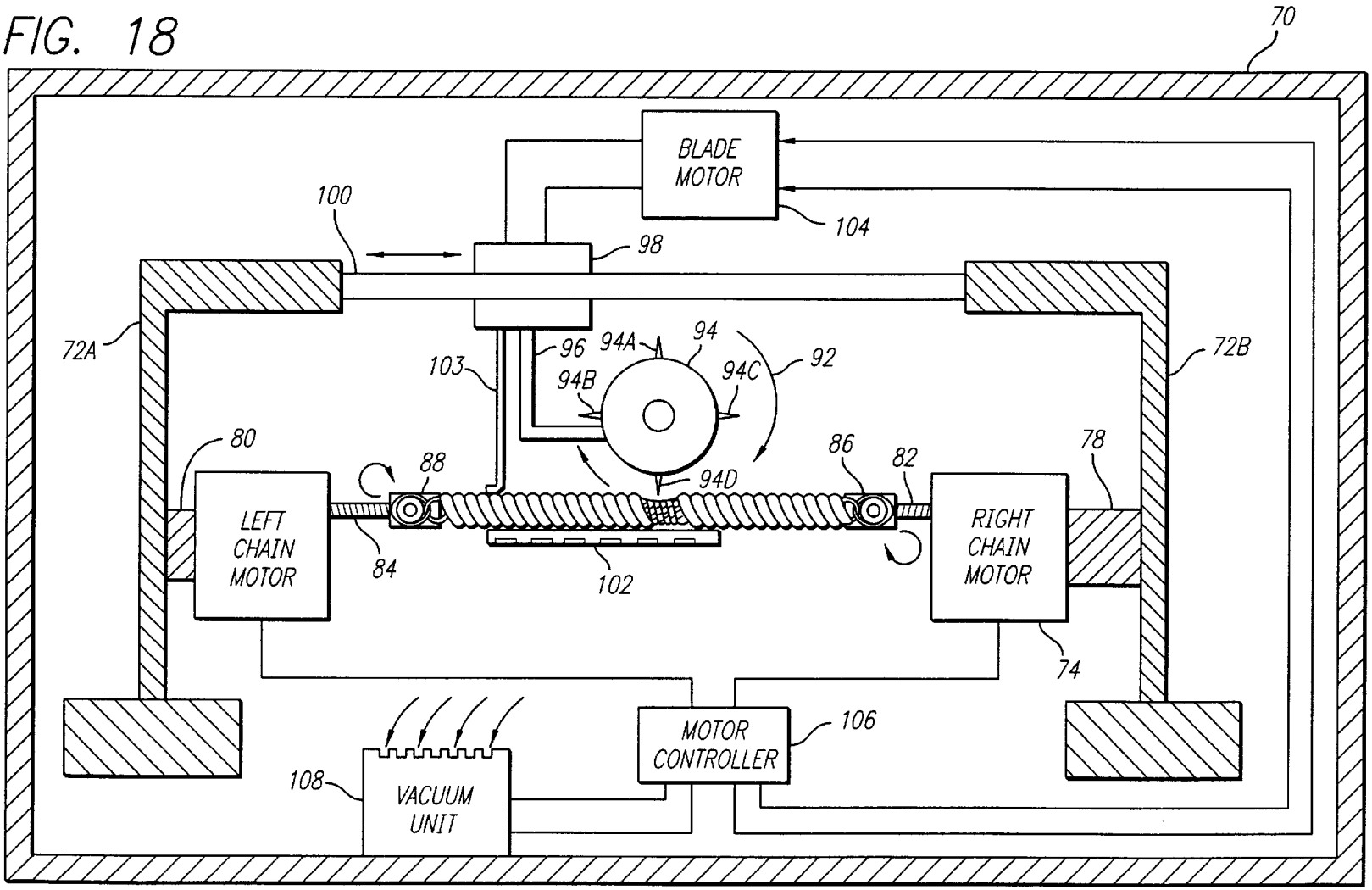
FIG. 18 schematically illustrates an apparatus for making a spiral diamond cut on a rope chain in accordance with the present invention.
Figure 19A:
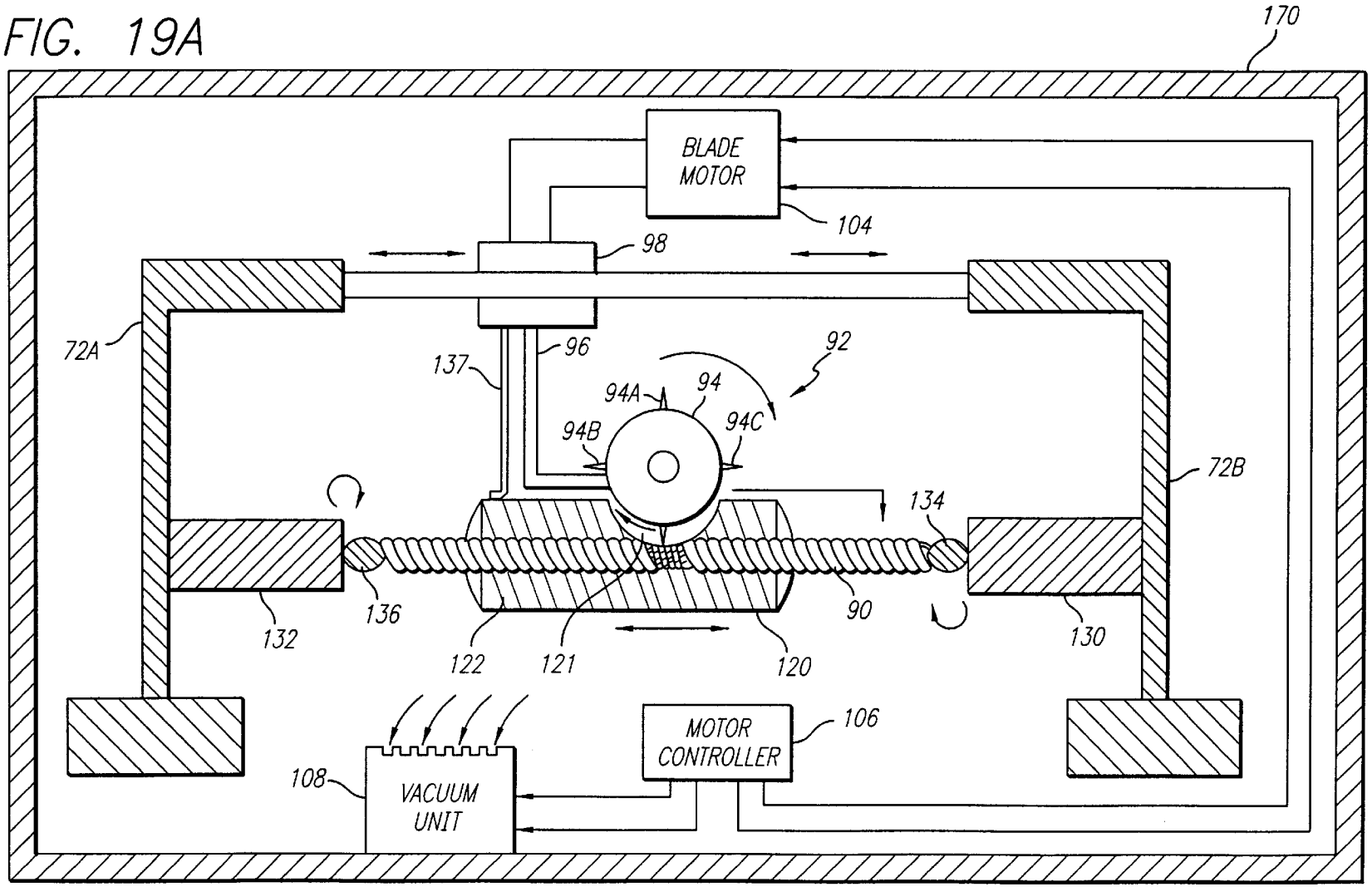
FIG. 19A schematically illustrates another embodiment of the apparatus of FIG. 18 for making a spiral diamond cut on a rope chain in accordance with the present invention.

Referring to FIG. 18, a schematic representation of a spiral diamond cutting apparatus 70 is shown having platforms 72A and 72B positioned opposite each other, a right chain motor 74 mounted on prop 78 being itself secured to platform 72B and a left chain motor 76 mounted on prop 80 being itself secured to platform 72A. Each of motors 74 and 76, is equipped with a chuck 82 and 84, respectively, which can be of the type similar to the chuck in a power drill. Each of the chucks 82 and 84 is equipped with a tensioner, such as tensioners 86 and 88 respectively, for holding and tensioning a jewelry rope chain 90 in a horizonal orientation between the motors. The tensioners 86 and 88 may be metal springs encased in a shell or other mechanical or electrical type of tensioning device suitable for the intended purpose of the inventive method and apparatus. Each of the motors 74 and 76 is capable of rotating the chucks 86 and 88 (and the attached tentioner) at variable speeds and may rotate in sequential steps if desired.

Positioned directly over the chain 90 is a rotating diamond cutting tool 92. Diamond, cutting tool 92 comprises a disk-shaped rotating diamond cutting bit 94 with one or more diamond blades for cutting precious metals. As an example, the diamond cutting bit 94 can have diamond blades 94A, 94B, 94C and 94D attached thereto. The disk-shaped diamond cutting bit 94 can be made of hardened steel or any other materials suitable for the intended purpose of the present invention. Diamond cutting bit 94 is mounted via an appropriately sized mounting rod 96 to the bottom surface of a sliding mechanism 98 which is capable of sliding horizontally back and forth parallel to the longitudinal axis of stretched rope chain 90. Sliding mechanism 98 slides on a rail 100 which is attached at each end to platforms 72A and 72B respectively. The length of rail 100 is sufficient to provide movement of diamond cutting tool 92 along the entire length of the tensioned rope chain 90.

The diamond blade bit may be adjustably positionable relative to the rope chain to provide for appropriate positioning of the cutting blade for various types and sizes of rope chains being cut. Therefore, the diamond blade bit may be moved up, down, sideways, and at any desired angle relative to the surface being cut and then locked in the selected position to perform the cutting operation.

For cutting hollow rope chains, the blades are adjusted so as not to remove a substantial portion of the strand material as hollow rope chain links are typically thin walled. As an example, blades 94A–D can be adjusted on the diamond cutting bit 94 so that when the cutting bit 94 rotates one or more of the blades 94A–D clears the rope chain being cut. At least one of the blades 94A–D is positioned to make light contact with the surface of the hollow rope chain so as to polish the surface of the hollow rope chain without removing a substantial portion of the material of the hollow rope chain links. For example, the blade 94A–D making light contact with the surface of the hollow rope chain would remove 0.0001 mm or less of the material of the hollow rope chain.

Figure 22:
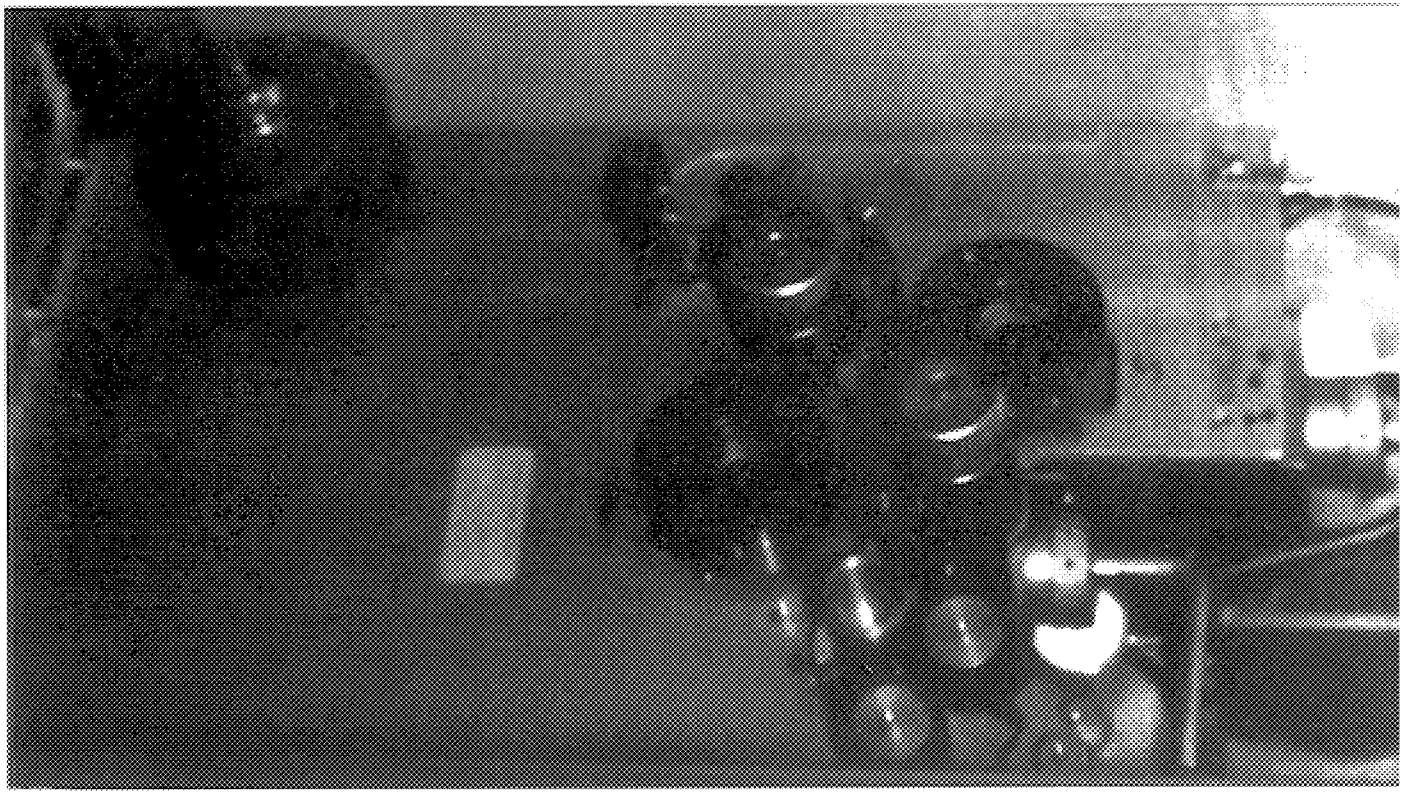
FIG. 22 is a photograph of a rotating diamond cutting machine.

As can be seen in FIG. 22, an example of a machine having a rotating diamond cutting bit is shown manufactured by F.O.V., Vicenza, Italy. Other types of machines having a rotating diamond cutting blade are known and available from manufacturers such as SISMA, Italy, and CHETAN for example. None of these machines provides for the rotation of a rope chain about its longitudinal axis to create a spiral diamond cut as taught by the present invention.

A chain support 102 is also removably mounted via an appropriately sized mounting rod 103 and conventional bolts adjacent mounting rod 96 to the bottom surface of sliding mechanism 98. The chain support 102 supports and stabilizes the portion of rope chain 90 which is being cut by the rotating diamond cutting bit 94.

The sliding mechanism 98 is powered by blade motor 104 which is connected together with motors 74 and 76 to a motor controller 106 for automatic control of the cutting operation. Blade motor 104 may also rotate in sequential steps if desired.

The apparatus 70 further contains a vacuum unit 108 which is also connected to and controlled by motor controller 106. The vacuum unit is shown spaced apart from the cutting area, however, the vacuum unit is preferably placed in close proximity to the diamond cutting bit 94 so as to aspirate and collect any precious metal particles and debris generated during the cutting operation. Aspiration and collection of the debris is preferred as the price of precious metal is relatively high making it desirable for the operator not to waste any precious metal.

Apparatus 70 can be a self-contained unit, preferably provided with a pair of transparent plastic or glass doors (not shown) to allow access to the cutting area for the operator. The control buttons of the motor controller 106 are preferably installed outside of the cutting area for easy handling.

The outer shell of apparatus 70 and its internal rigid parts, with the exception of the diamond blades are preferably made of steel or similar hard material suitable for the intended purpose of the present invention. The outside dimensions of apparatus 70 can be varied depending on the length of uncut rope chain that is desired to be cut.

The inventive spiral diamond cutting operation is as follows. The operator mounts to apparatus 70 rope chain 90 desired to be cut by attaching each end of rope chain 90 to tensioners 86 and 88, respectively. The rope chain 90 is placed over chain support 102 for proper operation. The rope chain 90 is tensioned and ready for cutting.

Depending on the type of spiral cut desired, the operator may mount one or more diamond blades 94*a*, 94*b*, 94*c* and 94*d*, etc. on the disk-shaped diamond cutting bit 94. The diamond cutting bit 94 is designed to allow changing of the cutting angle relative to the surface being cut or to accommodate different sizes and shapes of diamond blades.

The operator actuates the motor controller to actuate the three motors, namely blade motor 104, right chain motor 74, and left chain motor 76, at the same time. The motor controller 106 may be pre-programmed to advance the movement of each motor in discrete sequential steps so that the operation of all three motors is synchronized during the cutting operation. Rope chain 90 is rotated about its longitudinal axis as the two chucks 82, 84 are spinning at a controlled speed. At the same time as the rope chain 90 is spinning, diamond cutting bit 94 rotates at a controlled speed and moves in a controlled fashion along the longitudinal axis of the rope chain 90 cutting the outer surface of rope chain 90 at a predetermined depth. Since the horizontal movement of diamond cutting tool 92 is coordinated with the rotation of the rope chain 90, a high quality, smooth and even spiral diamond cut is achieved. At the end of the movement of the diamond cutting tool 92 from one end of the rope chain 90 to the other end, the operator disengages the finished rope chain 90 from the chucks and a shiny and sparkling spiral diamond cut jewelry rope chain is fabricated.

FIG. 19A schematically depicts another embodiment of the novel spiral diamond cutting apparatus 170 for making a desired spiral diamond cut on a jewelry rope chain in accordance with the present invention. Apparatus 170 is similar to apparatus 70 described above, except that motors 74 and 76 and their corresponding chucks and tensioners have been removed. On this case, each end of the rope chain 90 is tensioned by a pair of free spinning bushings 134 and 136 respectively. Bushing 134 is coupled to a prop 130 so as to be free spinning with the prop in turn being mounted to platform 72B. Bushing 136 is coupled to a prop 132 so as to be free spinning, with the prop in turn being mounted to platform 72A.

Diamond cutting tool 92 is the same as in apparatus 70 except that chain support 102 has been replaced by a novel open-ended tubular chain carrier 120 having an opening 121 approximately at its top to provide access to and cutting of the chain surface by diamond cutting bit 94. The chain carrier 120 has a series of spiral internal grooves 122 which match the strand orientation of the helical rope chain 90. Each internal groove is dimensioned to accommodate each of the helical strands of chain 90. Chain carrier 120 is removably mounted to the bottom of sliding mechanism 98 via mounting rod 137 and conventional bolts.

Figure 19B:
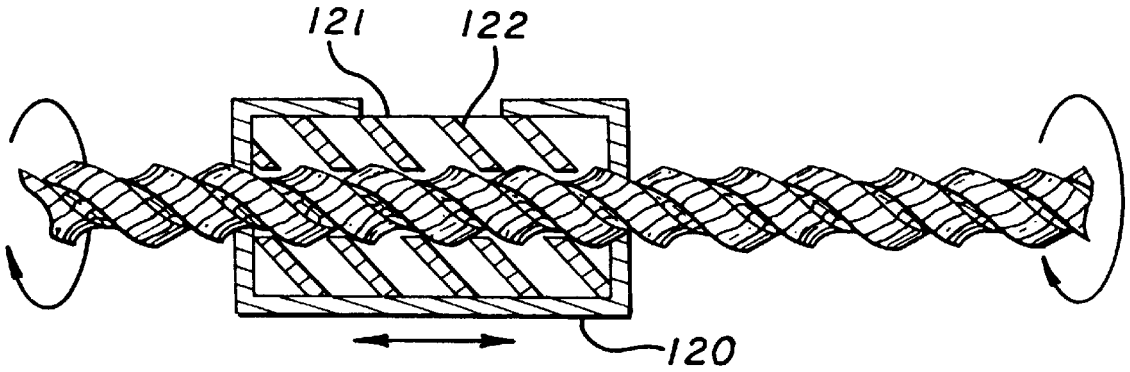
FIG. 19B is an exploded cross sectional view along the lines 19—19 of FIG. 19A of the rope chain held in the apparatus of FIG. 19A.

FIG. 19B shows an enlarged cross sectional view of chain carrier 120 and its internal grooves 122 and opening 121 with a portion of rope chain 90 passing through chain carrier 120.

In use of apparatus 170, the operator attaches one end of rope chain 90 to one of the free spinning bushings (134 or 136) and then threads the remaining portion of rope chain 90 through hollow chain carrier 120. The other end of rope chain 90 is then attached to the other free spinning bushing, and the motor controller is actuated.

As the blade motor 104 moves the rotating diamond cutting bit 94 and chain carrier 120 along the longitudinal axis of rope chain 90 from one end of the rope chain to the other, the internal spiral grooves 122 of chain carrier 120 cause rotation of the rope chain 90 by the motion of the carrier 120 relative to the chain. Rotation of the rope chain occurs because the strands of rope chain 90 passing through the chain carrier 120 experience torsional force from contact with the internal spiral grooves 122 as the chain carrier 120 is moved in a horizontal direction relative to the rope chain 90. Rotating diamond cutting bit 94 cuts the outer surface of the rope chain 90 in the region of opening 121 during operation and again as in the previous embodiment, a high quality, smooth and even spiral diamond cut is achieved at the end of a single run. Aspiration by vacuum unit 108 is again preferred to prevent waste of the precious metal being used.

Figure 21:
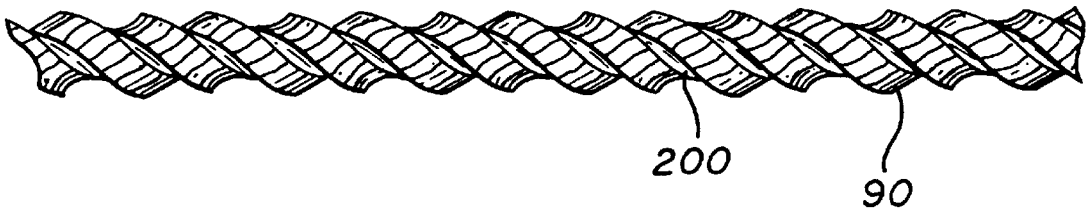
FIG. 21 is an enlarged view of the rope chain and guide wire of FIG. 20 coiled around the chain in accordance with the present invention.
Figure 20:
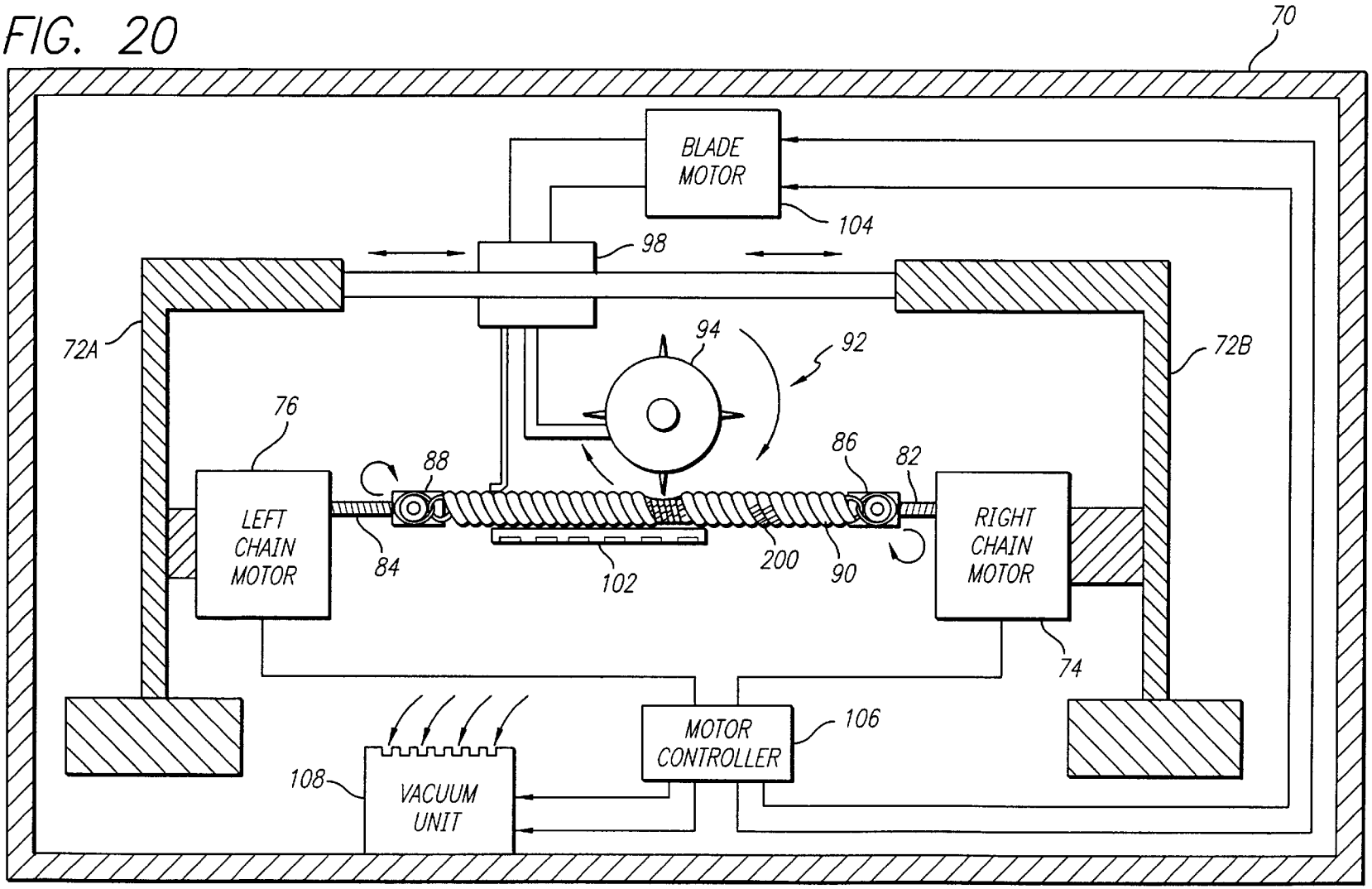
FIG. 20 schematically illustrates the apparatus of FIG. 18 and a rope chain with the addition of a guide wire spirally coiled around the chain in accordance with the present invention.

As can be seen in FIGS. 20–21, as an alternative method of holding the rope chain 90 in any of the above-described embodiments, a guide wire 200 having a much smaller diameter than the diameter of each strand of the rope chain is positioned between the individual strands of rope chain 90 such that the guide wire 200 is beyond the reach of the rotating diamond cutting bit 94. Guide wire 200 may be spirally coiled along the entire length of rope chain 90 in the spaces between the strands of the rope chain before mounting the rope chain 90 on the chain motors 74, 76 or the free spinning bushings 134, 136. Guide wire 200 may have a diameter in the range of 0.3 mm to 0.75 mm for use with a rope chain having an overall diameter of 3–5 mm for example. It is appreciated that the diameter of the guide wire 200 would be adjusted in accordance with the diameter of the rope chain being cut. The guide wire 200 prevents sagging of the rope chain 90 during the cutting operation, holds the links of the rope chain in a stable position, and provides additional guiding and structural support for the chain as the rotating diamond cutting bit 94 cuts the outer surface of rope chain 90 during operation as described above. After the desired type of spiral cut is accomplished, the guide wire 200 is manually or automatically uncoiled from the rope chain 90 and can be used repeatedly. The guide wire 200 may be made of steel, copper, or any other material suitable for the intended purpose of the present invention.

Alternatively, the inventive spiral diamond cutting apparatus 70 may be provided with a second rotating diamond cutting bit (not shown), also controlled by the blade motor 104, mounted to the bottom of sliding mechanism 98 and positioned preferably directly under the rope chain 90 at a predetermined spacing from the upper diamond cutting bit 94. Such a set up will result in additional types of spiral cuts possible. In such a case, appropriate modifications must be made to the chain carrier 120 and to the chain support 102 in order to accommodate the synchronous operation of two diamond cutting bits.

Alternatively, the rotating diamond blade bit may be in a fixed position with the rope chain being moved relative to the diamond blade bit. In this case, the rope chain may be coiled onto a spool and introduced into one side of the cutting apparatus with a suitable feeding mechanism for drawing the chain into the cutting apparatus and past the diamond blade bit. The cut rope chain would then exit the opposite side of the cutting apparatus and be similarly coiled onto a second spool. In this embodiment, the rope chain would be rotated about its longidunal axis by the feeding mechanism as it enters and exits the cutting apparatus to provide the necessary rotation of the chain to effectuate the spiral diamond cut of the rope chain.

The fabrication of spiral diamond cut jewelry rope chain in accordance with the above-described embodiments of the present invention is a significant step forward for the diamond cutting industry and will certainly result in increased demand for spiral diamond cut jewelry fabricated in accordance with the inventive method.

While the invention herein has been described by means of specific embodiments, numerous modifications and variations could be made thereto by those skilled in the art without departing from the scope of the invention set forth in the claims.

What is claimed is:

1. A method for creating a spiral diamond cut rope chain, said method comprising the steps of:

providing a rope chain having at least two strands with a plurality of links and a longitudinal axis;

providing a rotational cutting tool having a rotating cutting blade;

rotating said rope chain about said longitudinal axis; and cutting at least one of said strands of said rope chain with said rotational cutting tool while said rope chain is rotating about said longitudinal axis.

2. The method of claim 1, wherein said cutting step includes the sub-step of cutting at least two of said strands of said rope chain.

3. The method of claim 1, wherein said cutting step includes the sub-step of creating a cut outer surface of said at least one strand, said cut outer surface having a concave cross section.

4. The method of claim 1, wherein said cutting step includes the sub-step of creating a cut outer surface of said at least one strand, said cut outer surface having a convex cross section.

5. The method of claim 1, wherein said cutting step includes the sub-step of creating a cut outer surface of said at least one strand, said cut outer surface having a flat cross section.

6. The method of claim 1, wherein said cutting step includes the sub-step of creating a cut outer surface of said at least one strand, said cut outer surface having a cross-sectional shape other than circular.

7. The method of claim 1, wherein said cutting step includes the sub-step of cutting said rope chain with a diamond blade.

8. The method of claim 1, wherein said cutting step includes the sub-step of cutting said rope chain with a rotating disc having a plurality of diamond blades.

9. The method of claim 1, further comprising the step of providing a second rotational cutting toot for cutting said rope chain.

10. The method of claim 1, wherein said rotating step includes rotating said rope chain with a chain carrier having internal spiral grooves.

11. The method of claim 1, further comprising the step of evacuating debris generating during said cutting step.

12. The method of claim 1, wherein said cutting step and said rotating steps are synchronized.

13. The method of claim 1, further comprises the step of tensioning said rope chain prior to the cutting step.

* * * * *